United States Patent [19]

Imbeault

[11] 4,202,460

[45] May 13, 1980

[54] SECTIONAL FLOATING COVER

[76] Inventor: Fernand A. Imbeault, 112 St. Paul St. West, 5th Floor, Montreal, Canada, H2Y 1Z3

[21] Appl. No.: 895,928

[22] Filed: Apr. 13, 1978

[51] Int. Cl.[2] ..... B65D 21/02

[52] U.S. Cl. ..... 220/218; 220/23.4; 220/75

[58] Field of Search ..... 220/216, 218, 23.2, 220/23.4, 23.8, 75

[56] References Cited

U.S. PATENT DOCUMENTS

| | | | |
|---|---|---|---|
| 244,649 | 7/1881 | Newell | 220/216 |
| 279,635 | 6/1883 | Brewster | 220/75 |
| 289,557 | 12/1883 | Reinecke | 220/218 |
| 1,639,625 | 8/1927 | Afonin | 220/218 |
| 2,867,347 | 1/1959 | Champagnat | 220/216 |
| 3,774,799 | 11/1973 | Heisterberg | 220/216 |

FOREIGN PATENT DOCUMENTS

| | | | |
|---|---|---|---|
| 617376 | 1/1959 | Italy | 220/218 |
| 840641 | 7/1960 | United Kingdom | 220/216 |
| 841976 | 7/1960 | United Kingdom | 220/216 |

*Primary Examiner*—Joseph Man-Fu Moy

[57] ABSTRACT

A sectional floating cover used to control vapor losses from storage tanks and other similar vessels containing volatile organic compounds, is disclosed. The floating cover comprises a plurality of buoyant steel chamber units secured together to form a continuous deck floating on the surface of the liquid in a storage tank. Each chamber unit includes an upper flat sheet, a corrugated lower sheet and sheet strips closing the ends of the corrugations. These parts are welded together in fluid-tight manner, so that the upwardly opening corrugations form independent fluid-tight cells. The units are easily assembled within the tank by simple bead connections readily accessible for crimping and resisting vertical shearing stresses.

11 Claims, 7 Drawing Figures

SECTIONAL FLOATING COVER

This invention relates to a sectional floating cover used to control vapor losses from storage tanks and other similar vessels containing volatile organic compounds.

BACKGROUND OF THE INVENTION

Some of the known existing floating covers consist of a thin and fragile membrane, of aluminum, secured to the top of pontoons which float on the surface of the liquid. This pontoon system leaves a 6" to 8" space between the surface of the liquid and the membrane, and this traps vapors in that space. Therefore, if a break or puncture of the membrane occurs, all these vapors are lost. Furthermore, aluminum does not resist the caustic and chloride environment which can be present in the tanks.

Another system consists of conventional steel pans floating on the surface of the liquid. This system was developed many years ago and is now outdated, because it is expensive, requires a long time for installation and is definitely sinkable. Apart from the above, its performance is further hampered in Northern climates.

Still another known system consists of an aluminum honeycomb type cover which floats on the liquid. However, aluminum does not offer any resistance to the caustic and chloride environment.

SUMMARY OF THE INVENTION

It is therefore the object of the present invention to provide a cover which is virtually unsinkable, is of the contact type with the surface of the liquid and offers corrosion resistance to caustic, chloride and other types of corrosive agents.

The sectional floating cover for storage tanks, in accordance with the invention, comprises a plurality of buoyant chamber units secured together to form a continuous, rigid buoyant deck floating on the surface of the liquid in the storage tank.

Each chamber unit consists of an upper flat rigid sheet, a lower corrugated rigid sheet, joined in fluid-tight manner to the edges of the upper sheet and the top of the corrugations, being also joined to the upper sheet and rigid sheet strips closing in fluid-tight manner; the ends of the chamber unit. Thus, the upwardly opening corrugations form separate buoyant cells. The sheets and strips are preferably stainless steel or galvanized steel.

One longitudinal edge of the corrugated sheet of each chamber unit preferably extends downwardly for a predetermined length to form a free lip and the other longitudinal edge of the corrugated sheet of each chamber unit extends downwardly by a slightly longer length and is bent upwardly to form an upwardly opening bead of U-shaped cross-section, so as to fit over such one longitudinal edge free lip of the corrugated sheet of an adjacent chamber unit, thus permitting crimping of the adjacent lip and bead; to secure together two adjacent chamber units. Alternatively, one longitudinal edge of the corrugated sheet of each chamber unit may extend upwardly for a predetermined length to form a free lip and the other longitudinal edge of the corrugated sheet of a chamber unit extends upwardly for a slightly longer length and being bent downwardly to form a U-shaped bead so as to fit over the free lip of the corrugated sheet of an adjacent chamber unit, thereby also permitting crimping of the adjacent lip and bead to secure two adjacent chamber units.

The upper longitudinal edge of one end strip of each chamber unit may extend upwardly for a predetermined length and the upper longitudinal edge of the other end strip also extends upwardly for a slightly longer length and is bent downwardly so as to fit over the one longitudinal edge and strip of an adjacent chamber unit, thereby permitting crimping of the two adjacent edges to secure together two adjacent chamber units.

The adjacent chamber units are preferably longitudinally staggered to increase rigidity of the floating cover.

An additional rigid, flat sheet may be secured in fluid-tight manner underneath the corrugated sheet and to the lower edges of the sheet strips to improve the buoyancy of the chamber units by the formation of additional hermetically sealed closed buoyant cells from the downwardly opening corrugations.

LIST OF THE DRAWINGS

The invention will now be disclosed, by way of example, with reference to preferred embodiments illustrated in the accompanying drawings, in which.

DESCRIPTION OF A PREFERRED EMBODIMENT

Figure 1:
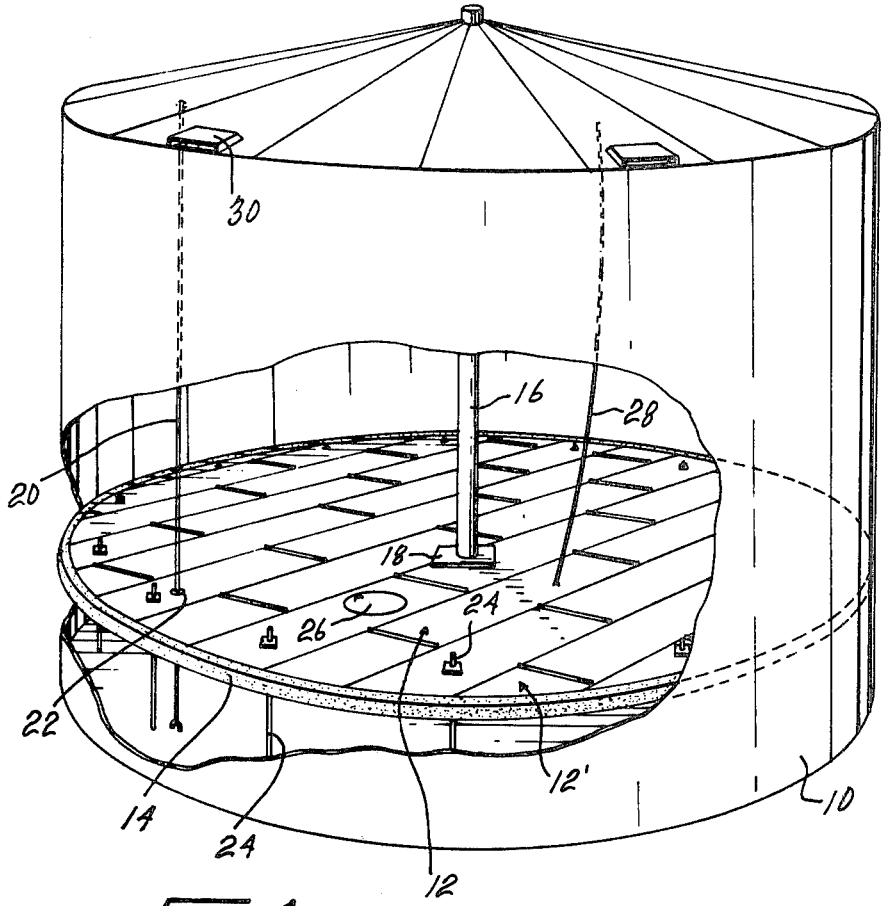
FIG. 1 illustrates a perspective view of a typical storage tank equipped with a sectional floating cover in accordance with the invention.

Referring to FIG. 1, there is shown a typical volatile organic compound storage tank 10 equipped with a sectional floating cover in accordance with the present invention and consisting of several buoyant rigid chamber units 12 interconnected to form a continuous rigid deck floating on the surface of the liquid in the tank. Further chamber units are secured together longitudinally and laterally, so as to form a hermetically sealed continuous deck and are preferably staggered to improve rigidity. The chamber units 12' adjacent to the wall of the tank are cut to conform to the shape of the tank. In order to accommodate the variations in the tolerance of the tank, a gap of about 6" to 12" is left between the wall of the tank and the edge of the floating cover and perimeter seals 14 are provided for preventing vapors from escaping around the edge of the cover. The permanent roof of the tank is often supported by columns or posts 16 and the floating cover is provided with a seal 18 around the columns or posts. A cable 20 is secured between the bottom and the top of the tank to prevent rotation of the floating cover in the tank. Such cable is also sealed by seal 22. The floating cover rests on supporting legs 24, which are higher than the diffusers, mixers or piping existing in the bottom of the tank and permits easy access to the bottom of the cover. At least one manhole 26 is also provided in one of the chamber units to give access of the bottom of the tank when the tank is emptied for cleaning or repair, or for installation or repair to the floating cover. An anti-static cable 28 is also attached to the top of the floating cover. Ventilation and access openings 30 are also provided on the top of the tank.

Figure 2:
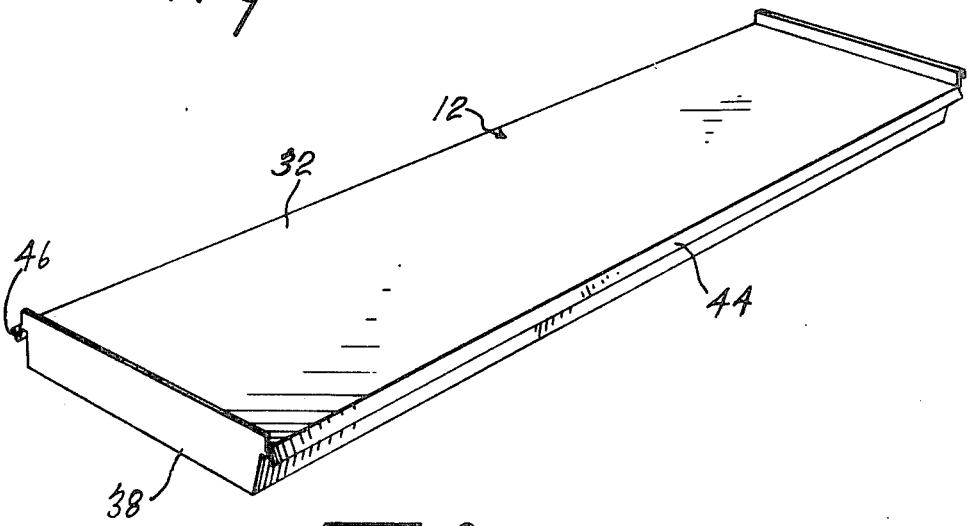
FIG. 2 illustrates a perspective view of a buoyant steel chamber unit which is used for making the sectional floating cover in accordance with the invention.
Figure 3:
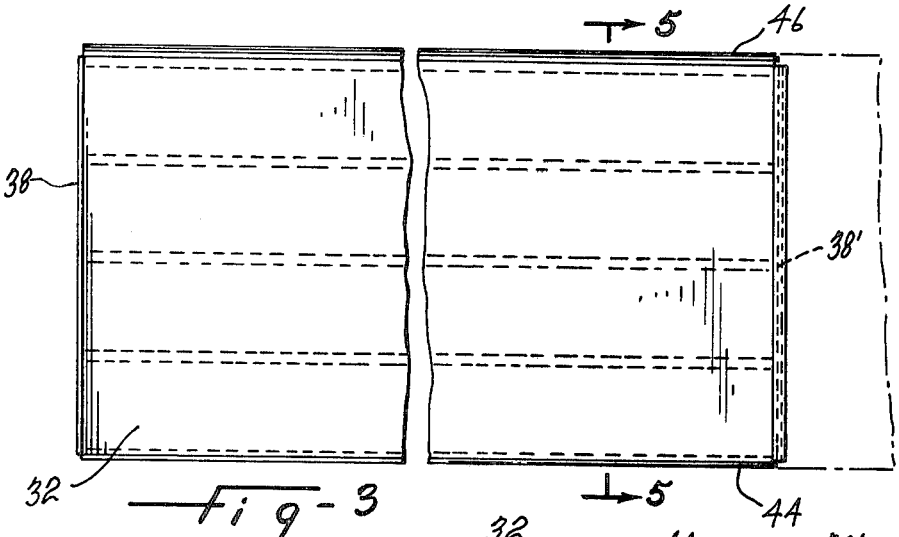
FIG. 3 illustrates a plan view of the unit.
Figure 4:
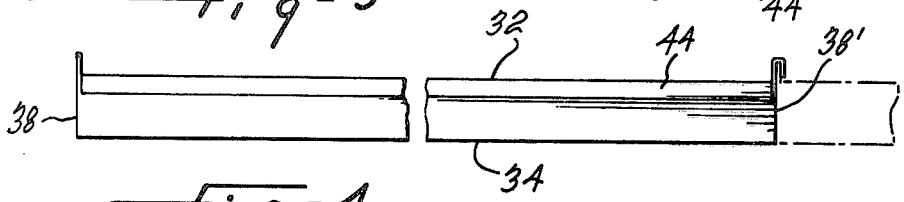
FIG. 4 illustrates a longitudinal elevation of the unit of FIG. 3.
Figure 7:
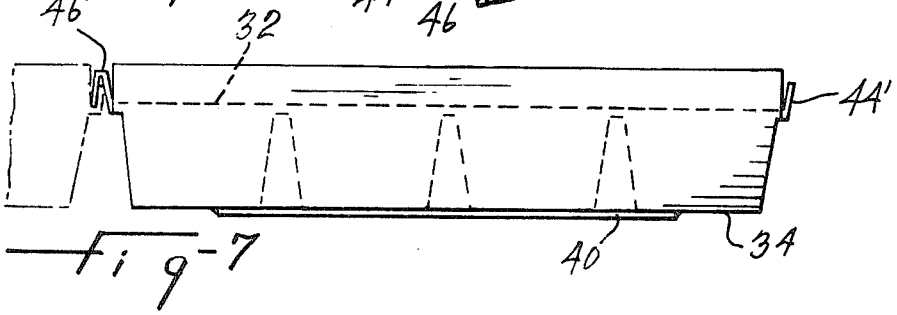
FIG. 7 illustrates an end view of an alternative embodiment of a chamber unit.

Referring now to FIGS. 2 to 4, there is shown an example of a chamber unit which may be 5–20′ long and 2–5′ wide, depending on the application. Each chamber unit includes an upper flat sheet 32 and a lower corrugated sheet 34 joined to the flat sheet 32 in fluid-tight manner or not at the upper ridges 36 of the corrugations, as by seam- or spot-welding. Sheet 34 forms uniform upwardly opening corrugations alternating with uniform downwardly opening corrugations of smaller width than the upwardly opening corrugations. Those marginal portions of the corrugated sheet 34 which are parallel to the corrugations are joined to the upper sheet 32 in fluid-tight manner, as by ordinary edge-welding. The chamber units are closed by end sheet strips 38, which are joined in fluid-tight manner as by welding so that the assembly of upper sheet 32, corrugated sheet 34 and the upwardly opening corrugations the edges of the upper and lower sheets to form a hermetically-sealed chamber unit having a plurality of separate buoyant cells. The multi-cell arrangement for each unit confers rigidity thereto and greatly improves the security of the buoyancy of the cover, since upper ridges 36 are located above the float line of the chamber units. However, for small chamber units, joints 36 may not be required and the chamber unit would then consist of a single cell. For large chamber units, an additional flat sheet 40 may be joined to the bottom of corrugated sheet 34 to increase rigidity (see FIG. 7) and make a contact type floating cover. The sheets are strips are preferably made of galvanized or coated steel, or of stainless steel having a thickness of 0.02–0.04″. Adequate rigidity is provided by the corrugations and by the transversely extending and sheet strips 38.

It is to be understood that the shape of the corrugations may vary, provided that sufficient air spaces are defined between the upper and corgated sheets to permit floating of the chamber unit. The walls 42 of the corrugations are also preferably inclined to insure lateral stability of the chamber units.

One longitudinal edge 44 of the corrugated sheet of each chamber unit extends beyond the associated free edge of upper sheet 32 and downwardly by a predetermined length to form a free standing lip, while the other longitudinal edge 46 also extends beyond the associated free edge of upper sheet 32 and downwardly for a slightly longer length and is then bent upwardly so as to form a U-shaped bead adapted tc fit around the corresponding edge 44 of an adjacent chamber unit in order to permit crimping of the edges together to hermetically connect adjacent chamber units. Caulking or welding may be used, if necessary, to improve the seal or the rigidity of the deck. As the chamber units are preferably staggered, such crimping, or optional welding, will increase the longitudinal rigidity of the deck. Of course, the longitudinal edges of the corrugated metal sheet of each chamber unit may extend upwardly, such as shown at 44′ and 46′ in FIG. 7 of the drawings, so as to permit crimping, caulking or welding from the top of the floating cover. It will be noted that the joined corrugated sheets 34 of assembled chamber units form a continuous membrane preventing the liquid and its vapors from corroding upper sheet 22.

Figure 5:
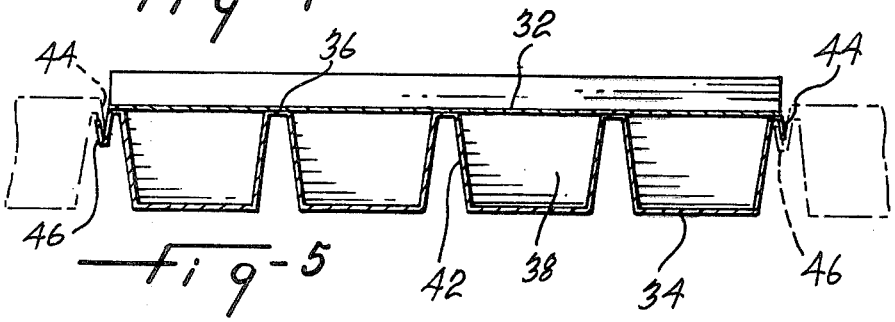
FIG. 5 illustrates a cross-section taken along line 5—5 of FIG. 3.
Figure 6:
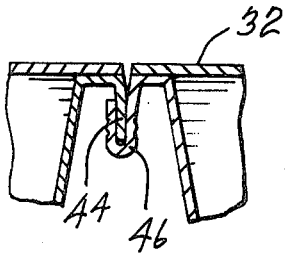
FIG. 6 is a partial cross-section of two joined units.

Referring to FIGS. 2 and 3, it is seen that the width of end strips 38 and 38′ is greater than the thickness of the chamber unit. The upper longitudinal edge of one end strip 38 extends upwardly for a predetermined length to form an upward free lip and the upper longitudinal edge of the other end strip 38′ extends for a slightly longer length and is then bent downwardly so as to form an inverted U-shaped bead to fit around the corresponding lip of an adjacent edge strip 38, in order to be able to crimp the lip and bead together to connect the adjacent chamber units. Caulking or welding may also be used, if necessary, to improve the seal or the rigidity of the deck. In both embodiments of FIGS. 5 and 7 and in the embodiment of FIG. 4, it is seen that the connections between the chamber units are beaded seams, in which the contiguous edges of sheets or strips of two adjacent chamber units are lapped, folded and pressed together.

During installation, the chamber units are assembled and sealed to each other by crimping, caulking or welding in rows. They are preferably staggered in each row to improve rigidity. The seals 14 are then installed all around the tank, together with seals 18, 22, so as to permit the cover to raise or lower with the level of the liquid in the tank. While preventing vapors to escape around the free edges.

It is important to note that very little vapor can be formed due to the improved structure of the chamber units. Indeed, referring to FIG. 5, the chamber units are designed so that the floating line is at about mid-elevation and that the volume of air contained above the top of the liquid between the individual cells is relatively small. Thus, there is very little evaporation due to the gradient of temperature between the ambient temperature and the temperature of the liquid in the tank. Such limited amount of evaporation is also trapped by the end strips of each chamber unit. Optimal bottom plate 40 can eliminate this, as it forms a complete contact type cover.

It is also important to note that the corrugations in the chamber units provide rigidity of the floating cover and permit to fill the tank at higher flow rate without the risk of damaging the floating cover.

Although the invention has been disclosed with reference to a preferred embodiment, it is to be understood that it is not limited to such embodiment and that alternative embodiments are also envisaged within the scope of the claims. For instance, other types of chamber units are envisaged and the invention is not limited to the embodiment disclosed and shown.

I claim:

1. A sectional floating cover for storage tanks and similar vessels, comprising a plurality of buoyant, rigid chamber units secured together, in longitudinal rows with the chamber units in end-to-end relation in each row to form a continuous, rigid deck floating on the surface of the liquid in the storage tank, each chamber unit being rectangular in plan view and having straight longitudinal edges and straight end edges, each chamber unit consisting of an upper, flat rectangular sheet, a lower corrugated sheet coextensive with said upper flat sheet and joined to said upper flat sheet, said corrugated sheet forming a plurality of uniform upwardly opening corrugations alternating with uniform downwardly opening corrugations, said corrugations solely extending longitudinally of said upper flat sheet, the upper ridge of each corrugation abutting against, and secured to, the upper flat sheet, the marginal portions of said corrugated sheet parallel to said corrugations, forming a gas- and liquid-tight joint with the corresponding longitudinal edges of the upper flat sheet, flat sheet strips longitudinally extending across and secured in gas- and liquid-tight manner to the ends of said corrugations and to the corresponding end edges of said upper flat sheet, said sheet strips having a width greater than the thickness of the chamber unit to form edge portions freely protruding from the chamber unit, the assembly of said upper flat sheet, said flat strips and the upwardly opening corrugations closed by said upper flat sheet constituting a plurality of separate buoyant cells in each chamber unit, first connecting means formed along and co-extensive with the longitudinal edges of each chamber unit and connecting chamber units of adjacent rows one to another, each first connecting means consisting of a gas and liquid-tight and rigid beaded seam in which the contiguous longitudinal edges of said last-named chamber units are lapped, folded and pressed together, and second connecting means rigidly joining said edge portions of the sheet strips of adjacent chamber units of any given row, said first and second connecting means resisting shear stress between connected adjacent chamber units.

2. A sectional floating cover as defined in claim 1, wherein the upper ridge of each corrugation is secured to the flat sheet in fluid-tight manner, so that each cell is a hermetically sealed enclosure.

3. A sectional floating cover as defined in claim 1, wherein the lower ridges of said corrugations are flat and co-planar and further including an additional flat sheet abutting against, and secured to, said flat portions and secured to the lower edges of said sheet strips to form additional cells with the downwardly opening corrugations.

4. A sectional floating cover as defined in claim 1, wherein said marginal portions of said corrugated sheet extend free of said upper flat sheet and form said seam.

5. A sectional floating cover as defined in claim 1 or 4, wherein said second connecting means consist of a beaded seam between the edge portions of said sheet strips, said edge portions being lapped, folded and pressed together.

6. A sectional floating cover for storage tanks and similar vessels comprising a plurality of buoyant rigid chamber units adapted to be secured together to form a continuous, rigid deck floating on the surface of the liquid in the storage tank, each chamber unit consisting of an upper flat sheet having straight edges, a lower corrugated sheet coextensive with said flat sheet and joined to said upper sheet, said corrugated sheet forming a plurality of uniform upwardly opening corrugations alternating with uniform downwardly opening corrugations, of smaller width than the upwardly opening corrugations, with the upper ridge of each corrugation abutting against, and secured to, the upper flat sheet, the marginal portions of said corrugated sheet parallel to said corrugations, forming a fluid-tight joint with the corresponding straight edges of the upper flat sheet, one of said marginal portions being extended by a free lip disposed at an angle relative to said upper flat sheet, the other and opposite one of said marginal portions being extended by a free standing bead of U-shaped cross-section and disposed at an angle relative to said upper flat sheet and adapted to be crimped around the free lip of an adjacent chamber unit with the resultant beaded connection located in a plane generally perpendicular to said upper flat sheet, flat sheet strips extending across and secured in fluid-tight manner to the ends of said corrugations and to the corresponding straight edges of said upper flat sheet, the assembly of said upper flat sheet, said flat strips and the upwardly opening corrugations closed by said upper flat sheet constituting a plurality of separate buoyant cells in each chamber unit, the upper edge portion of both sheet strips being extended above said upper flat sheet, one of said upper edge portions forming an upstanding free lip and the other and opposite one of said upper edge portions being a free standing bead of inverted U-shaped cross-section adapted to be crimped around the last-named free lip of an adjacent chamber unit.

7. A sectional floating cover as defined in claim 6, wherein the upper ridge of each corrugation is secured to the flat sheet in fluid-tight manner, so that each cell is a hermetically sealed enclosure.

8. A sectional floating cover as defined in claim 6, wherein the lower ridges of said corrugations are flat and co-planar and further including an additional flat sheet abutting against, and secured to, said flat portions and secured to the lower edges of said sheet strips to form additional cells with the downwardly opening corrugations.

9. A sectional floating cover as defined in claim 8, wherein said additional flat sheet is secured to said flat portions and to said lower edges of sheet strips in fluid-tight manner, whereby said additional cells are separate hermetically closed enclosures.

10. A sectional floating cover as defined in claim 6, wherein said first-named free lip and first-named bead extend downwardly below said upper flat sheet and said first-named bead opens upwardly.

11. A sectional floating cover as defined in claim 6, wherein said first-named free lip and said first-named bead extend upwardly above said upper flat sheet and said first-named bead opens downwardly.

* * * * *